US006095803A

United States Patent [19]

Slater

[11] Patent Number: 6,095,803

[45] Date of Patent: Aug. 1, 2000

[54] THERMOPLASTIC ADHESIVE MATERIALS CONVEYING SYSTEM

[76] Inventor: G. Barry Slater, R.D. #359A, Seaford, Del. 19973

[21] Appl. No.: 09/325,783

[22] Filed: Jun. 4, 1999

[51] Int. Cl.[7] ..... B67D 5/63; F27B 3/20

[52] U.S. Cl. ..... 432/13; 432/161; 222/146.2; 222/146.5

[58] Field of Search ..... 432/13, 138, 161, 432/215; 414/161, 167; 222/146.2, 53, 146.5

[56] References Cited

U.S. PATENT DOCUMENTS

| | | | |
|---|---|---|---|
| 3,768,552 | 10/1973 | Ciraud | 432/215 |
| 3,832,430 | 8/1974 | Noziere | 432/13 |
| 3,938,976 | 2/1976 | Walker | 65/29 |
| 3,964,645 | 6/1976 | Scholl . | |
| 3,981,416 | 9/1976 | Scholl . | |
| 4,026,237 | 5/1977 | Flanagan . | |
| 4,821,922 | 4/1989 | Miller et al. | 222/146.2 |
| 5,447,254 | 9/1995 | Scott et al. . | |
| 5,650,083 | 7/1997 | Bondeson . | |
| 5,662,243 | 9/1997 | Bondeson . | |
| 5,685,911 | 11/1997 | Raterman et al. . | |
| 5,814,790 | 9/1998 | Bondeson et al. . | |
| 5,934,521 | 8/1999 | Yamada et al. | 222/146.2 |

*Primary Examiner*—Denise L. Ferensic
*Assistant Examiner*—Gregory A. Wilson
*Attorney, Agent, or Firm*—Scally, Scally & McMahon, P.A.; Richard M. McMahon, Sr.

[57] ABSTRACT

This invention relates to a Hot Melt Glue Conveying System and in particular to a system for improving the material handling of thermoplastic adhesive chips to provide the uninterrupted flow of hot melt glue to packaging production lines. This invention reveals both a system and a method which improves the material handling efficiency and reduces the maintenance and down-time of a system for conveying solid glue chips or particles from a bulk source in the proper continuous glue volume to a glue melting apparatus. This system has filters at various points in the conveying system to screen the particle size of material flowing through and to minimize foreign particles in the system. This conveying system includes sensing devices that determine the material flow volume and vacuum at various gates, valves and hoppers in the system and sends an electronic signal to the control unit of those readings. The Hot Melt Glue Conveying System also includes a control unit which receives, displays and controls the operation of the conveying, converting and dispensing of the hot melt glue system.

20 Claims, 3 Drawing Sheets

THERMOPLASTIC ADHESIVE MATERIALS CONVEYING SYSTEM

BACKGROUND OF THE INVENTION

1. Field of the Invention

The present invention relates generally to a method of conveying, controlling and dispensing thermoplastic material. More particularly, this invention pertains to a process and an apparatus for conveying, filtering, and feeding a high throughput of solid thermoplastic adhesive material with continuous, smooth, controlled and batch flow of the hot melt resin adhesive resulting in minimal degradation of the molten thermoplastic material into a dispensing device capable of preventing dripping of the molten hot melt glue upon controlled shutoff of the dispensing process. The method and apparatus of this invention reduces both the maintenance and downtime of the process in comparison to currently available systems.

2. Description of the Prior Art

Many thermoplastic adhesive materials degrade or oxidize when exposed to heat or oxygen for extended periods of time. It is desirable to minimize duration of time that hot melt glue remains in a molten state to avoid degradation of its adhesive properties. This is achieved by some application systems by balancing the rate of application of the hot melt glue with the thermoplastic adhesive material melt rate and conveying of the system U.S. Pat. No. 3,981,416 discloses an apparatus similar to the device in U.S. Pat. No. 3,964,645 patented by the same inventor. These two patents claim a novel heating grid meter and an infeed system, which forcibly moves the molten hot, melt glue into the pump inlet.

The primary objective of this invention is to provide batch conveyed, smooth, controlled and uninterrupted flow of the hot melt adhesive resulting in no degradation or oxidation of the molten adhesive material while fully meeting the requirements of a high throughput application system.

Another objective of this invention is to provide an initial filtering method to screen out any contaminants or foreign particles from the thermoplastic adhesive chips, chiclets, or pellets being fed into the hot melt material system. Prior systems using filters or screens have maintenance problems and downtime associated with cleaning the screens in order to avoid clogging and to attempt to provide uninterrupted flow of the solid glue material from a bulk source.

Another traditional problem with thermoplastic adhesive systems is the clogging of the glue chip hopper and a build-up of partially solidified glue in the feed lines from the hopper leading directly to the glue melter apparatus. This phenomenon occurs because heat flows up the lines from the glue melter device to the glue chip hopper. Various heat-insulating techniques have been used to greatly reduce this problem. A build-up of partially solidified glue in these lines results in downtime to remove the material and excess maintenance costs. U.S. Pat. No. 5,447,254 discloses an intermittent dispensing apparatus, which is equipped with a dispensing head in the discharge passageway whereby the exhaust air from the dispenser is directed into the air passageway so as to blow off and remove the excess liquid hot melt glue material from the nozzle dispensing head. An air passageway extends through the valve upstream of the discharge end of the dispenser such that pressurized air is directed into the air passageway during the shut-off cycle whereby the dripping and drooling hot liquid material is effectively blown out. This apparatus is a novel dispenser, which prevents dripping of the molten hot melt glue upon shut off of the application dispenser. However, this patent does not address the problem of a build-up of partially solidified glue in the lines leading into the glue melter itself.

Another objective of this invention is to provide an integrated conveying system for thermoplastic adhesive materials from a bulk source such as a Gaylord container or a 55 gal. drum container of the raw materials into the hot melt glue chip conveying system which permits fully emptying the thermoplastic adhesive materials from the source. Devices for sensing the level of solid materials in various containers have long been used. The resulting levels of such solid materials have been detected and displayed. No previous hot melt glue chip conveying system has used the solid material level sensed in a bulk material source to automatically activate other component systems such as vibration, vacuum, or conveyors to fully empty the bulk material source.

Other hot melt glue chip conveying systems consist of devices such as in U.S. Pat. No. 5,685,911 which reveals an apparatus for intermittently applying discrete patterns of hot melt glue onto substrate areas that require such defined discrete glue patterns such as book spines, pinch bottom bags, sift-proof cartons and the like. In U.S. Pat. No. 5,814,790, the invention is for an apparatus and method for supplying hot melt glue using a plurality of hoppers with controlled heating zones with temperature sensor devices for non-uniform application of heat to the thermoplastic material during the several stages of melting and dispensing process. This device is for an apparatus, which receives a partially melted thermoplastic material and has four additional heaters connected to a progressive staged heating grid. This patent does not address the entire hot melt glue chip conveying system nor does it disclose the overall system required for delivery of the solid glue material to the very first stage apparatus therein.

SUMMARY OF THE INVENTION

In accordance with the invention, a Hot Melt Glue Conveying System wherein solid thermoplastic adhesive chips are drawn into a vacuum material line through a tubular wand device inserted into a bulk material container containing hot melt glue chips, chiclets or pellets. An air vibrator is activated whenever the vacuum fill cycle starts due to low level supply of glue chips in the melter hopper, thereby causing the bulk material container to vibrate and the remaining thermoplastic adhesive chips relocating for vacuum pickup by the wand. The material line is equipped with a purge valve, and the material line is attached to an inlet stub in the vacuum chamber assembly having a screen filter and a purge feature utilizing diaphragm pulse and solenoid valves. Control panel activation of the solenoid valve causes the pulse valve to deliver a blast of compressed air towards the screen filter resulting in the larger glue particles dropping onto the dump valve while the hot melt glue fines are directed by the vacuum line to the secondary filter. Hot melt glue chips are vertically fed directly from the vacuum chamber assembly through the counter-weighted dump valve which directs the solid thermoplastic adhesive material to the vacuum chamber converging cone. The vacuum chamber cone is equipped with a discharge fitting having an air metering valve which allows a small amount of air to enter the chute discharge assembly and thereby prevents hot moist air from migrating up the chute assembly into vacuum chamber cone. The chute discharge assembly of this invention leads directly to a glue chip converging hopper equipped with a filter and a level probe volume sensor. The hot melt glue chip hopper is attached directly to the customers' glue melting apparatus through a mounting flange. The vacuum line system of this invention is equipped with a vacuum breaker valve with a solenoid valve fitted with a secondary cartridge filter, which accumulates glue chip fines thereby preventing them reaching the vacuum power unit for the system. The Hot Melt Glue Conveying System is equipped with a control panel device, which integrates the electronic controls and displays readings from the various sensors contained in the system.

DETAILED DESCRIPTION

Figure 1:
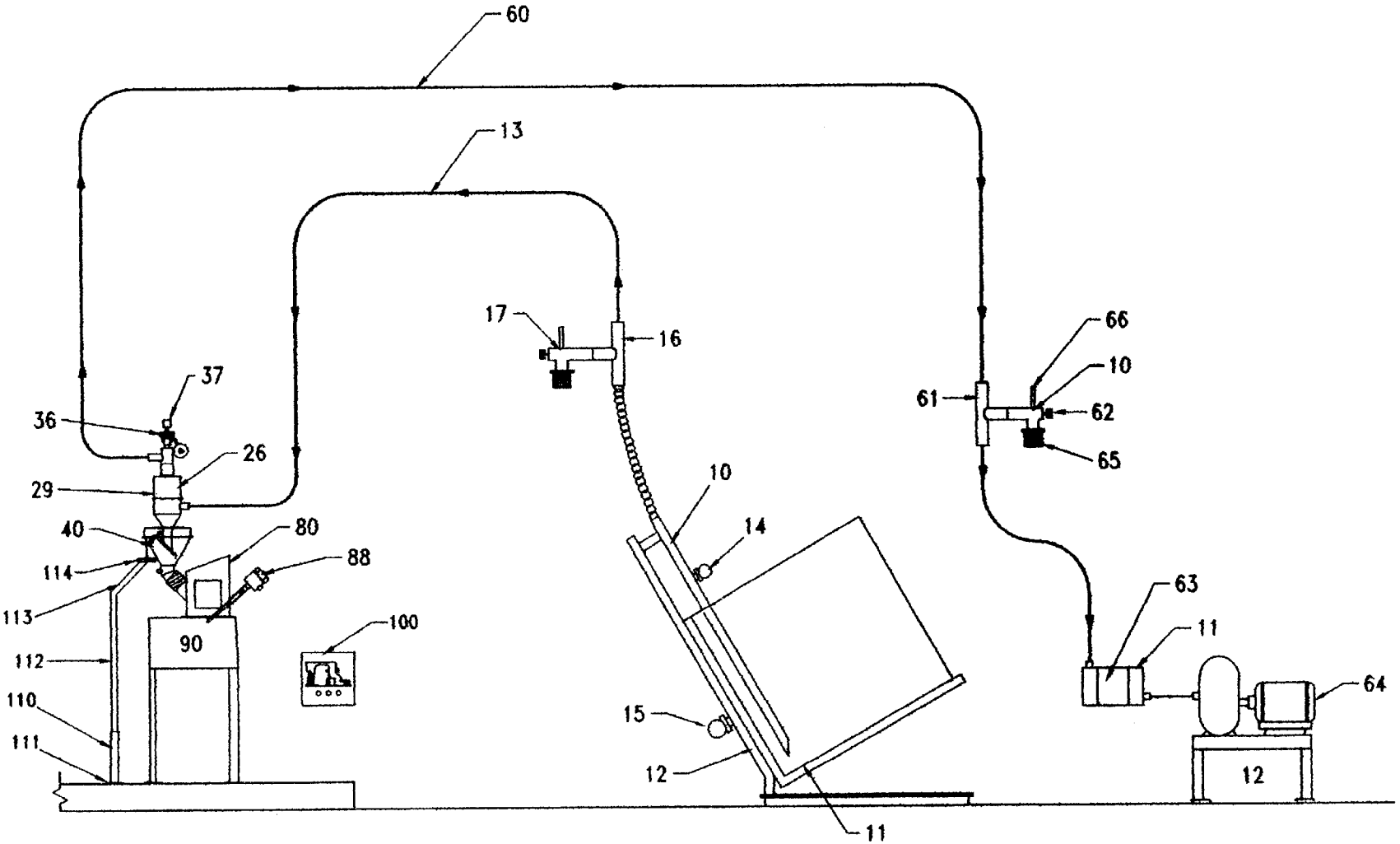
FIG. 1 is a schematic representation of the Hot Melt Glue Conveying System and the method taught by this invention showing all of the major components of this invention

Referring to the drawings for a better understanding of the present invention, this invention is susceptible to embodiment in several different forms. The description which follows should be viewed as an illustration of the principles of the invention and is not intended to limit this invention to the embodiments illustrated in the drawings herein.

FIG. 1 is an overall view of the Hot Melt Glue Conveying System and the method taught by this invention. FIG. 1 depicts the entire system showing all of the major components. The material pick-up wand 10 is inserted into a bulk material container 11, which contains solid hot melt glue chips, chiclets or pellets. The bulk material container 11 is supported on container stand 12, and the base elevates automatically as the remaining thermoplastic adhesive material weight is reduced in the container to a maximum 30° angle to the floor to encourage the flow of the solid thermoplastic adhesive material towards pick-up wand tube 10 to facilitate pick-up of the material by the vacuum in material line 13.

Material line 13 is joined to "T" (tee) tube 16 on two sides of the "T" tube as shown in FIG. 1. Line purge valve 17 is joined to the remaining leg of "T" tube 16 to permit purging of air and thermoplastic adhesive material trapped in material line 13 after each batch conveying cycle. Material line 13 is constructed to the proper length for each installation using standard commercially available piping, flexible hose, couplings, elbows, and tee tubes.

Air vibrator 14 as shown in FIG. 1 is removably attached to wand tube 10. Air vibrator 14, which is intermittently in operation, causes wand tube 10 to vibrate and keep it immersed in the solid thermoplastic adhesive material within the bulk material container 11. The intermittent cycle of air vibrator 14 is controlled by the setting in control panel 100 based on the fill cycle. A second vibrator 15 is removably attached to container stand 12. Air vibrator 15, which is also intermittently in operation, causes container stand 12 to vibrate the solid thermoplastic adhesive material within the bulk material container 11 to flow towards wand 10. The intermittent cycle of air vibrator 15 is adjustable by the operator at the vibrator control valve.

Figure 2:
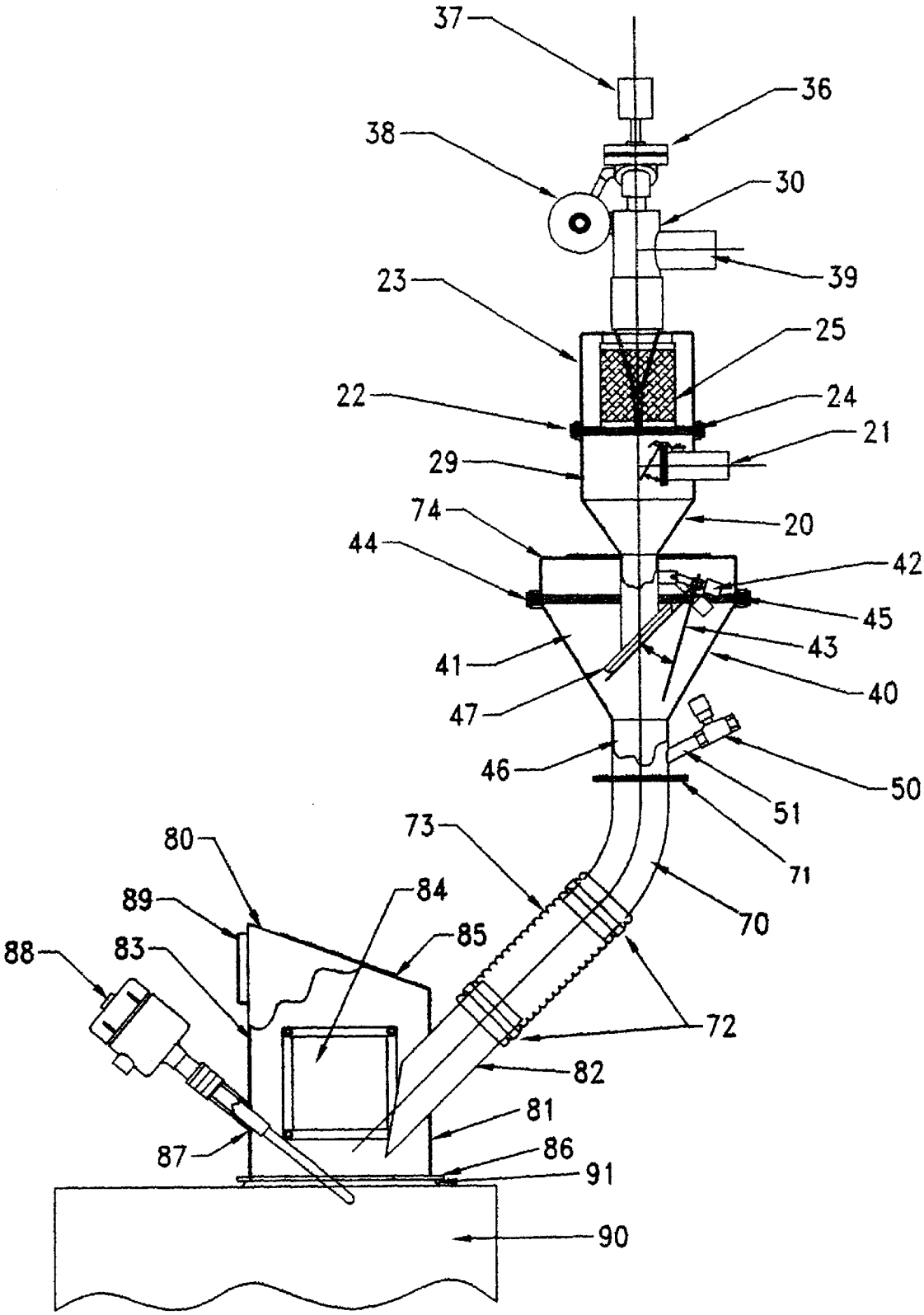
FIG. 2 is a cut away view of the Hot Melt Glue Conveying System showing the vacuum chamber assembly, dump valve, vacuum chamber converging cone assembly, chute discharge assembly, air flow control valve, glue chip converging hopper and glue melter device of this invention

Solid thermoplastic adhesive material is conveyed by vacuum through material line 13 into material inlet 21 affixed to vacuum chamber assembly 20 as shown in FIG. 2. Vacuum chamber assembly 20 includes vacuum chamber hopper 29, vacuum chamber lid 23 and air header assembly 30. Air header assembly 30 is rigidly attached to lid assembly 23 with an "O" ring and set screws to the vacuum outlet stub on the top of lid 23. Vacuum chamber mesh filter 25 is a replaceable mesh filter and is held in place with a washer and lock nut to lid assembly 23. Vacuum chamber mesh filter 25 screens and filters the hot melt glue chips and fines received in the glue chips. Clamping ring 22 and sealing gasket 24 are utilized in this invention to vertically removably attach lid assembly 23 and mesh filter assembly 25 to vacuum chamber hopper 29.

As seen in FIG. 2, Counter weighted dump valve assembly 47 opens by opening the hinged position of dump valve flap 43 which occurs when the fill cycle times out and the vacuum breaker valve 10 simultaneously opens. Hinged dump valve flap 43 closes by gravity action of the counter weight 42 in conjunction with the cyclical application of vacuum in this system. The timed cyclical interruption of vacuum causes hinged dump valve flap 43 to open and allows the volume of hot melt glue chips which have accumulated in vacuum chamber 20 to pass through the open hinged dump valve flap 43 and drop into the converging cone 41. A 60° conical converging cone 41 is the preferred embodiment component in converging cone assembly 40.

Vacuum line inlet 39 is rigidly affixed to air header assembly 30, and vacuum line 60, as shown in FIG. 2 is removably attached to vacuum line inlet 39. Air reservoir 38 is removably affixed to air header assembly 30 providing a reservoir of compressed air from an outside the system source for use in this invention. Pulse valve 36 is attached to the outlet side of air reservoir 38 and is preferably a diaphragm type valve vertically or horizontally joined to solenoid valve 37 atop air header assembly 30. These components provide an automatic means for cleaning mesh filter 25 in the system each time solenoid valve 37 is activated causing the air reservoir to purge itself through pulse valve 36. This air purge is directed towards mesh filter 25 causing the larger solid glue particles, which did not pass through mesh filter 25 to be dislodged by this blast of air and proceed downward in vacuum chamber hopper 29 to the counter weighted dump valve assembly 47 and enter glue converging cone assembly 40.This air purge function efficiently cleans mesh filter 25, vacuum chamber assembly 20, glue converging cone assembly 40 and chute assembly 70. The air purge reduces maintenance and eliminates downtime without having to shut the entire system down for unnecessary cleanings required by other hot melt glue systems.

Vacuum for this system is provided by vacuum power unit 64 comprising a blower, motor and assembly support. Vacuum power unit 64 is connected to vacuum line 60, vacuum breaker 62 with filter 65, and to the secondary filter 63. This secondary filter 63 screens and accumulates the hot melt glue chip fines in the system before they reach vacuum power unit 64. Vacuum line 60 is joined to "T" tube 61 on two sides of the "T" (tee) tube as shown in FIG. 1. Vacuum line breaker valve 62 is joined to the remaining leg of "T" tube 61 to permit purging of vacuum in material line 60 by operation of air cylinder 66. Vacuum line breaker valve 62 is electrically attached to control panel 100 which receives the electrical signals from, displays and controls operation of vacuum line breaker valve 62. Vacuum line 60 is constructed to the proper length for each installation using standard commercially available piping, flexible hose, couplings, elbows, and tee tubes.

Converging cone assembly 40 includes converging cone 41 with the assembly having a flanged inlet and flanged outlet, mounting lug, lid assembly 74, four nuts to attach vacuum chamber assembly 20 with four bolts, clamping ring 44 attached through sealing gasket 45.

Flanged discharge outlet 46 of converging cone assembly 40 is directly attached to the inlet flange 71 of chute assembly 70. The preferred embodiment for discharge outlet 46 is a 45° flanged elbow or straight flanged stub which matches the inlet flange 71 of chute assembly 70 and are bolted together with four bolts. Flanged discharge fitting 46 has a threaded fitting 51 with air metering valve 50 attached thereto. Air metering valve 50 allows a small amount of positive air to bleed continually into the flexible chute assembly 70 to keep the moist hot air from the glue melter 90 from migrating up chute assembly 70 through the converging cone 41 to the counter weighted dump valve 42 and sealing gasket 45. The flexible chute assembly also includes sections of flexible hose 73 joined together by hose clamp 72. Flexible hose 73 is attached by hose clamp 72 to the glue chip converging hopper inlet stub 82 of glue chip converging hopper assembly 80.

Figure 3:
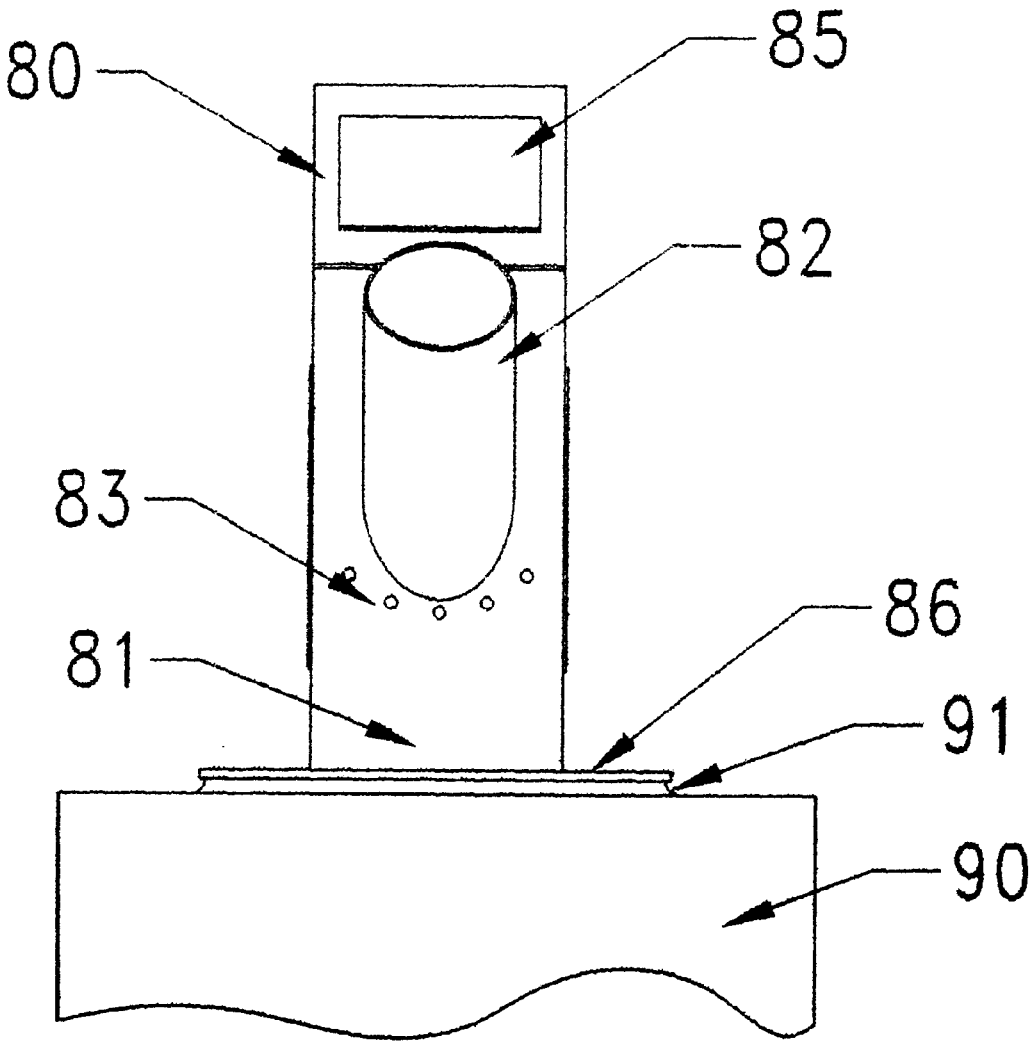
FIG. 3 is a cut away side view of the junction of the flex chute of the Hot Melt Glue Conveying System with the glue chip converging hopper also depicting the air ventilation holes used in this invention

FIG. 3 show the junction of glue chip converging hopper hose 73 attached to inlet stub 82 by clamp 72 at end of converging hopper hose 73 and to chute assembly 70 at other end. FIG. 3 shows the position of inlet stub 82 on inlet panel 81. Glue converging hopper assembly 80 has two bolted side access panels 84, a vented end panel 83 with a mesh filter 89, a hinged top access panel 85, a discharge bottom component with a flange mounting connector 86, and inlet panel 81. Inlet panel 81 also has multiple air vent holes 83 symmetrically spaced directly under inlet stub 82. These air vent holes 83 permit the flow of ambient temperature plant air into glue chip converging hopper assembly 80 where heated moist air from glue melter 90 rises within the glue converging hopper assembly device and exits end panel 83 through mesh filter 89 which screens in the glue particles and let the filtered heated air pass through to the outside. This filtering and flow of hot air functions, when coupled with the positive air bleed function within flexible chute assembly 70 sharply reduce the clogging of this invention with partially solidified hot melt glue material. This critical improvement by itself has reduced maintenance and down time with this apparatus many fold.

Thermoplastic adhesive chips from the system are directed from glue chip converging hopper assembly 80 into the customer's glue melter 90. The flanged mounting connector 86 is sized to match the inlet glue melter hopper 91 and is removably attached to the inlet glue melter hopper. High temperature level sensor probe 88 is inserted though fitting 87 of end panel 83. High temperature level sensor probe 88 is electrically connected to control panel 100 which displays the molten glue level in glue melter 90 at all times that this system is operational. Control panel 100 receives the electrical signals from high temperature level sensor probe 88 and the logic of this apparatus controls the flow of glue chips by transmitting an electrical signal which controls a control panel device which adjusts the cycle time for the next "on cycle" of vibrators 14 and 15 as well as controls operation of both vacuum line breaker valve 62 and air purge valve 17 to maintain molten hot melt glue level in the system at a level between the high and low level setting selected.

The apparatus is supported to the floor by support pipe assembly 110 which includes floor plate 111, vertical adjustable height upright pipe 112, angular support pipe 113 attached to the vertical upright pipe 112, and support clamp 114 attached at one end of angular support pipe 113 and the opposite end is adjustably attached converging cone assembly 40 providing vertical support to the device.

Control panel 100 includes graphic display of the entire system, indication lights showing the operating state of major components and valves, and sufficient computer like logic to monitor and control operation of the entire Hot Melt Glue Conveying System under varying operational conditions.

Although only a few exemplary embodiments of the present invention have been described in detail above, those skilled in the art will readily appreciate that many modifications and substitutions are possible in the exemplary embodiments without materially departing from the novel teachings and advantages of the invention. Accordingly, all such modifications and substitutions are intended to be included within the scope of the invention as defined in the following claims.

What is claimed is:

1. An improved system for conveying and converting solid thermoplastic adhesive material to molten thermoplastic adhesive and for dispensing the thermoplastic adhesive material comprising:

a bulk source of solid thermoplastic adhesive material, means for continuous conveying solid thermoplastic adhesive material from bulk source to a vacuum chamber, said vacuum chamber having a screen filter with an air reservoir attached to a pulse valve connected to a means for activation to deliver compressed air towards the screen filter whereby thermoplastic adhesive material fines pass through the screen filter into line filters, and larger thermoplastic adhesive material particles is fed onto a counter-weighted dump valve, the said vacuum chamber converging hopper receives solid thermoplastic adhesive material particles from the counter-weighted dump valve, an air metering valve in the discharge of the vacuum chamber converging hopper, a chute discharge connected to the vacuum chamber converging hopper discharge, a thermoplastic adhesive material converging hopper attached to the said chute discharge having air vent holes in the inlet panel and a screen filter in the vented end panel, a thermoplastic adhesive material melter attached to the converging hopper which applies uniform heat to the material converting the thermoplastic adhesive material to a molten state, and an electronic control device which senses, monitors, displays and controls the system.

2. A system as claimed in claim 1, wherein said means for conveying solid thermoplastic adhesive material is a vacuum system comprising a blower and motor connected to vacuum line and a vacuum breaker having a filter and a secondary filter.

3. A system as claimed in claim 1, wherein said means for activating release of compressed air is a solenoid valve activated by an electrical signal from the said electronic control device.

4. A system as claimed in claim 1, wherein the air-metering valve allows air to enter the chute discharge preventing hot moist air from migrating up the chute into the vacuum chamber cone.

5. A system as claimed in claim 1, wherein the electronic control device is a control panel, which integrates the electronic controls and displays readings from the various sensors contained in the system.

6. A system as claimed in claim 1, wherein the electronic control device is a control panel, which graphic displays the system showing the operating state of major components and with logic to monitor and control operation of the system.

7. A system as claimed in claim 1, wherein the bulk source of solid thermoplastic adhesive material includes one or more air vibrators attached to the bulk container source containing solid materials which are activated in the system whenever there is a fill cycle requirement for the continuous supply of solid thermoplastic adhesive material in the material line, thereby causing the bulk material container or a wand to vibrate resulting in the remaining thermoplastic adhesive material relocating allowing pickup by the said wand.

8. A method of conveying and converting solid thermoplastic adhesive material to molten thermoplastic adhesive and for dispensing the thermoplastic adhesive material comprising:

A method of continuous conveying solid thermoplastic adhesive material from a bulk material source to one or more chambers having a filter with an air reservoir attached to a means for activation to deliver compressed air towards the filter whereby hot melt glue fines pass through the screen filter, and larger hot melt glue particles are fed onto a counter-weighted dump valve attached to the vacuum chamber discharged, attached to a vacuum chamber hopper which receive the solid hot melt glue particles from the said dump valve and fitted with an air metering valve in the discharge of the second chamber, having a chute discharge connected to the second chamber, a hot melt glue converging hopper attached to the chute discharge having air vent holes in the inlet panel and filter in the vented end panel, and a glue melter attached to the converging hopper which uniformly melts the solid glue material converting the solid glue material to a molten state, and an electronic control device which senses, monitors, displays and controls the system.

9. A method as claimed in claim 8, wherein said method for conveying solid hot melt glue material is a vacuum system comprising a blower and motor connected vacuum line and vacuum breaker having a filter and secondary filter.

10. A method as claimed in claim 8, wherein said method for activating release of compressed air is a solenoid valve activated by an electrical signal from the said electronic control device.

11. A method as claimed in claim 8, wherein the air-metering valve allows air to enter the chute discharge preventing hot moist air from migrating up the chute into the second chamber.

12. A method as claimed in claim 8, wherein the electronic control device is a control panel, which integrates the electronic controls and displays readings from the various sensors contained in the system.

13. A method as claimed in claim 8, wherein the electronic control device is a control panel, which is a graphic display of the system showing the operating state of major components and with logic monitor and control operation of the system.

14. A method as claimed in claim 8, wherein the bulk source of solid hot melt glue material includes one or more air vibrators attached to the bulk container source containing solid materials which are activated in the system whenever there is an interruption to the continuous supply of solid hot melt glue material in the material line, thereby causing the bulk material container or a wand to vibrate resulting in the remaining hot melt glue material relocating allowing pickup by the said wand.

15. An integrated system for conveying, liquefying and dispensing thermoplastic adhesive material comprising:

A batch means for conveying solid thermoplastic adhesive materials from a bulk source to one or more vacuum chambers having a filter, An air reservoir having a source of compressed air attached to a pulse means, which upon activation, delivers a blast of compressed air towards the said filter dislodging thermoplastic adhesive fines which pass through the filter to a line filter and the larger thermoplastic adhesive particles which are dislodged and fed onto a dump valve, a vacuum chamber converging hopper receives the solid thermoplastic adhesive materials from the dump valve, an air metering means is affixed to the discharge of the vacuum chamber converging hopper and chute is attached to the said vacuum chamber converging hopper discharge, a solid thermoplastic adhesive materials converging hopper, with air vent holes in the inlet panel and a screen filter housed in the hopper end panel, is removably attached to the chute, a solid thermoplastic adhesvie materials melter means attached to the a solid thermoplastic adhesive materials which applies heat to the material converting and liquefying the thermoplastic adhesive material to a molten stage for dispensing, an electronic control means to sense, monitor and control the system.

16. A system as claimed in claim 15, wherein said means for conveying solid thermoplastic adhesive material is a vacuum system comprising a blower and motor connected to vacuum line and a vacuum breaker having a filter and a secondary filter.

17. A system as claimed in claim 15, wherein the means for activating release of compressed air is a solenoid valve controlled by an electrical signal from the said electronic control device.

18. A system as claimed in claim 15, wherein the air-metering valve allows air to enter the chute discharge preventing hot moist air from migrating up the chute into the vacuum chamber converging hopper and on to vacuum chamber dump valve and cone.

19. A system as claimed in claim 15, wherein the electronic control device is a control panel, which is a graphic display of the system showing the operating state of components and with logic to monitor and control operation of the system and display readings from the various sensors contained in the system.

20. A system as claimed in claim 15, wherein the bulk source of solid thermoplastic adhesive material includes one or more air vibrators attached to the bulk container source containing solid materials which are activated in the system whenever there is a fill cycle to supply solid thermoplastic adhesive material in the material line, thereby causing the bulk material container or a wand to vibrate resulting in the remaining thermoplastic adhesive material relocating allowing pickup by the said wand.

* * * * *